US012379143B2

(12) United States Patent
Shen et al.

(10) Patent No.: US 12,379,143 B2
(45) Date of Patent: Aug. 5, 2025

(54) HEAT PUMP SYSTEM AND CONTROL METHOD THEREOF

(71) Applicant: Carrier Corporation, Palm Beach Gardens, FL (US)

(72) Inventors: Guangyu Shen, Shanghai (CN); Guang Zhang, Shanghai (CN); Hui Zhai, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 264 days.

(21) Appl. No.: 18/158,675

(22) Filed: Jan. 24, 2023

(65) Prior Publication Data

US 2023/0235932 A1 Jul. 27, 2023

(30) Foreign Application Priority Data

Jan. 25, 2022 (CN) ..... 202210084626.X

(51) Int. Cl.
*F25B 47/02* (2006.01)
*F25B 41/20* (2021.01)

(52) U.S. Cl.
CPC ..... *F25B 47/022* (2013.01); *F25B 41/20* (2021.01); *F25B 2347/02* (2013.01)

(58) Field of Classification Search
CPC .... F25B 47/022; F25B 41/20; F25B 2347/02; F25B 2313/02741; F25B 2313/02742
See application file for complete search history.

(56) References Cited

U.S. PATENT DOCUMENTS

2019/0203994 A1* 7/2019 Nakagawa ..... F25B 47/02

FOREIGN PATENT DOCUMENTS

| | | | | |
|---|---|---|---|---|
| CN | 109579364 A | * | 4/2019 | ..... F25B 13/00 |
| CN | 213841110 U | | 7/2021 | |
| EP | 2884205 A1 | | 6/2015 | |
| WO | WO-2010082325 A1 | * | 7/2010 | ..... F25B 13/00 |
| WO | 2018208539 A1 | | 11/2018 | |

OTHER PUBLICATIONS

Machine English language translation of CN109579364 to Duan et al. Translated Dec. 2024 (Year: 2019).*
Machine English language translation of WO2010082325 to Morimoto et al. Translated Dec. 2024 (Year: 2010).*
European Search Report for Application No. 23153142.7, Issued Jun. 1, 2023, 8 Pages.

* cited by examiner

*Primary Examiner* — Cassey D Bauer
(74) *Attorney, Agent, or Firm* — CANTOR COLBURN LLP

(57) ABSTRACT

A heat pump system includes a compressor; an indoor heat exchanger; an outdoor heat exchanger configured as an interlaced heat exchanger having at least two refrigerant flow paths; a plurality of throttling elements; and a first type four-way valve and a second type four-way valve, with ports thereof respectively connected to the inlet and the outlet of the compressor, the indoor heat exchanger, and one of the at least two refrigerant flow paths of the outdoor heat exchanger; in a local defrosting mode, refrigerant from the outlet of the compressor flows respectively through the indoor heat exchanger and at least one of the at least two refrigerant flow paths of the outdoor heat exchanger, and then sequentially through the throttling elements, at least the other of the at least two refrigerant flow paths of the outdoor heat exchanger, and the inlet of the compressor.

12 Claims, 4 Drawing Sheets

HEAT PUMP SYSTEM AND CONTROL METHOD THEREOF

FOREIGN PRIORITY

This application claims priority to Chinese Patent Application No. 202210084626.X, filed Jan. 25, 2022, and all the benefits accruing therefrom under 35 U.S.C. § 119, the contents of which in its entirety are herein incorporated by reference.

TECHNICAL FIELD OF INVENTION

The present application relates to the field of air-conditioning equipment, and in particular to a heat pump system and a control method thereof.

BACKGROUND OF THE INVENTION

As highly mature equipment, heat pump systems are widely used in commercial buildings, household space and other places, which can provide relatively comfortable cooling/heating effects. However, engineers in this field are still committed to optimizing and improving various aspects, one of which is to provide directional defrosting for different locations of the components.

Defrosting mode is a common function for heat pump systems, which usually functions in winter when heat pump systems are used for heating. At this point, heat exchangers in the outdoor unit that are already in low temperature environment are still used to absorb heat to evaporate refrigerant in the pipelines. Finned pipelines on the outside surface of outdoor heat exchangers are prone to frosting in such low temperature and high humidity environments. Therefore, defrosting mode becomes an essential operation, i.e., a reversing operation is performed by switching the flow path switch valve, so that high-temperature gas-phase refrigerant discharged from the compressor flows directly into the outdoor heat exchangers and defrosts through heat dissipation of the high-temperature refrigerant.

However, defrosting mode of this type is usually performed on all pipelines of a condenser. It is suitable for extremely harsh frosting environment. For normal frosting environment, however, different parts of the condenser may be more prone to frosting due to factors such as installation environment and wind direction. Of course, the aforementioned defrosting mode can still defrost in this case. However, it can lead to interruption of the heating mode and unnecessary energy loss at the same time.

In addition, part of the heat in defrosting mode (e.g., about 25%) is lost. For example, a lot of the heat is lost in the air where heat transfer is carried out, and a lot of the heat is lost in heating the metal components of the heat exchangers (e.g., heat-exchange copper tubes or fins).

SUMMARY OF THE INVENTION

The object of the present application is to provide a heat pump system and a control method thereof, so as to at least partially solve or alleviate the problems in the prior art.

To achieve at least one object of the present application, according to one aspect of the present application, a heat pump system is provided, which comprises: a compressor having an air inlet and an air outlet; an indoor heat exchanger; an outdoor heat exchanger configured as an interlaced heat exchanger having at least two refrigerant flow paths; a plurality of throttling elements respectively arranged between any two of the indoor heat exchanger and the at least two refrigerant flow paths of the outdoor heat exchanger; and a first type four-way valve and a second type four-way valve, with ports thereof respectively connected to the air inlet and the air outlet of the compressor, the indoor heat exchanger, and one of the at least two refrigerant flow paths of the outdoor heat exchanger; wherein, in a local defrosting mode, refrigerant from the air outlet of the compressor flows respectively through the indoor heat exchanger and at least one of the at least two refrigerant flow paths of the outdoor heat exchanger, and then sequentially through the throttling elements, at least the other of the at least two refrigerant flow paths of the outdoor heat exchanger, and the air inlet of the compressor.

In addition to one or more of the above features, or as an alternative, in another embodiment, the plurality of throttling elements comprise a first throttling element and a second throttling element; a three-way intersection point is provided on the connecting pipelines between the indoor heat exchanger and the two refrigerant flow paths of the outdoor heat exchanger. Wherein, the first throttling element is arranged on a first connecting pipeline between the three-way intersection point and the outdoor heat exchanger or the indoor heat exchanger; the second throttling element is arranged on a second connecting pipeline between the three-way intersection point and the outdoor heat exchanger or the indoor heat exchanger.

In addition to one or more of the above features, or as an alternative, in another embodiment, the plurality of throttling elements further comprise a first valve capable of controlling at least the on-off of the flow path; wherein, the first valve is arranged on a third connecting pipeline between the three-way intersection point and the outdoor heat exchanger or the indoor heat exchanger.

In addition to one or more of the above features, or as an alternative, in another embodiment, the first valve is configured as a third throttling element or a first solenoid valve.

In addition to one or more of the above features, or as an alternative, in another embodiment, when the first valve is configured as a third throttling element, in a local defrosting mode, refrigerant flows through two of the first throttling element, the second throttling element, and the third throttling element.

In addition to one or more of the above features, or as an alternative, in another embodiment, the heat pump system further comprises: a first solenoid valve arranged between the first type four-way valve and the indoor heat exchanger; and a second solenoid valve arranged between the second type four-way valve and the indoor heat exchanger.

In addition to one or more of the above features, or as an alternative, in another embodiment, the heat pump system further comprises: a first check valve arranged between the first type four-way valve and the indoor heat exchanger; a second check valve arranged between the second type four-way valve and the indoor heat exchanger; and a bypass branch, with a first end thereof connected to a common flow path between the first check valve, the second check valve and the indoor heat exchanger, and a second end thereof connected to the air inlet of the compressor; wherein, a third solenoid valve is provided on the bypass branch.

In addition to one or more of the above features, or as an alternative, in another embodiment, in a first combined defrosting mode, refrigerant from the air outlet of the compressor flows sequentially through at least one of the at least two refrigerant flow paths of the outdoor heat exchanger, the throttling elements, at least the other of the at least two refrigerant flow paths of the outdoor heat exchanger, and the air inlet of the compressor; and at the same time, refrigerant from the air outlet of the compressor flows sequentially through the indoor heat exchanger, the throttling elements, at least the other of the at least two refrigerant flow paths of the outdoor heat exchanger, and the air inlet of the compressor. Or, in a second combined defrosting mode, refrigerant from the air outlet of the compressor flows sequentially through at least the other of the at least two refrigerant flow paths of the outdoor heat exchanger, the throttling elements, at least one of the at least two refrigerant flow paths of the outdoor heat exchanger, and the air inlet of the compressor; and at the same time, refrigerant from the air outlet of the compressor flows sequentially through the indoor heat exchanger, the throttling elements, at least one of the at least two refrigerant flow paths of the outdoor heat exchanger, and the air inlet of the compressor.

In addition to one or more of the above features, or as an alternative, in another embodiment, in a first local defrosting mode, refrigerant from the air outlet of the compressor flows sequentially through at least one of the at least two refrigerant flow paths of the outdoor heat exchanger, the throttling elements, at least the other of the at least two refrigerant flow paths of the outdoor heat exchanger, and the air inlet of the compressor. Or, in a second local defrosting mode, refrigerant from the air outlet of the compressor flows sequentially through at least the other of the at least two refrigerant flow paths of the outdoor heat exchanger, the throttling elements, at least one of the at least two refrigerant flow paths of the outdoor heat exchanger, and the air inlet of the compressor.

In addition to one or more of the above features, or as an alternative, in another embodiment, the outdoor heat exchanger is configured to comprise a plurality of refrigerant flow paths, and a plurality of the first type four-way valves and/or the second type four-way valves are provided. Wherein, each of the first type four-way valves and/or each of the second type four-way valves connect to a refrigerant flow path respectively. Wherein, in a local defrosting mode, refrigerant from the air outlet of the compressor flows sequentially through a plurality of refrigerant flow paths connected to the first type four-way valve, the throttling elements, a plurality of refrigerant flow paths connected to the second type four-way valve, and the air inlet of the compressor; or refrigerant from the air outlet of the compressor flows sequentially through a plurality of refrigerant flow paths connected to the second type four-way valve, the throttling elements, a plurality of refrigerant flow paths connected to the first type four-way valve, and the air inlet of the compressor.

To achieve at least one object of the present application, according to one aspect of the present application, a control method for the aforementioned heat pump system is provided, which comprises: a first combined defrosting mode, in which pipeline connections between the first type four-way valve and the second type four-way valve are switched, so that the air outlet of the compressor is respectively communicated with at least one of the at least two refrigerant flow paths of the outdoor heat exchanger and the indoor heat exchanger, and at least the other of the at least two refrigerant flow paths of the outdoor heat exchanger is communicated with the air inlet of the compressor; wherein, refrigerant from the air outlet of the compressor flows sequentially through at least one of the at least two refrigerant flow paths of the outdoor heat exchanger, the throttling elements, at least the other of the at least two refrigerant flow paths of the outdoor heat exchanger, and the air inlet of the compressor; and at the same time, refrigerant from the air outlet of the compressor flows sequentially through the indoor heat exchanger, the throttling elements, at least the other of the at least two refrigerant flow paths of the outdoor heat exchanger, and the air inlet of the compressor; and/or a second combined defrosting mode, in which pipe connections between the first type four-way valve and the second type four-way valve are switched, so that the air outlet of the compressor is respectively communicated with at least the other of the at least two refrigerant flow paths of the outdoor heat exchanger and the indoor heat exchanger, and at least one of the at least two refrigerant flow paths of the outdoor heat exchanger is communicated with the air inlet of the compressor; wherein, refrigerant from the air outlet of the compressor flows sequentially through at least the other of the at least two refrigerant flow paths of the outdoor heat exchanger, the throttling elements, at least one of the at least two refrigerant flow paths of the outdoor heat exchanger, and the air inlet of the compressor; and at the same time, refrigerant from the air outlet of the compressor flows sequentially through the indoor heat exchanger, the throttling elements, at least one of the at least two refrigerant flow paths of the outdoor heat exchanger, and the air inlet of the compressor.

In addition to one or more of the above features, or as an alternative, in another embodiment, the control method further comprises: a first local defrosting mode, in which pipeline connections between the first type four-way valve and the second type four-way valve are switched, so that the air outlet of the compressor is communicated with at least one of the at least two refrigerant flow paths of the outdoor heat exchanger, and at least the other of the at least two refrigerant flow paths of the outdoor heat exchanger is communicated with the air inlet of the compressor; at the same time, the pipeline connection of the indoor heat exchanger is disconnected; wherein, refrigerant from the air outlet of the compressor flows sequentially through at least one of the at least two refrigerant flow paths of the outdoor heat exchanger, the throttling elements, at least the other of the at least two refrigerant flow paths of the outdoor heat exchanger, and the air inlet of the compressor; or a second local defrosting mode, in which pipeline connections between the first type four-way valve and the second type four-way valve are switched, so that the air outlet of the compressor is communicated with at least the other of the at least two refrigerant flow paths of the outdoor heat exchanger, and at least one of the at least two refrigerant flow paths of the outdoor heat exchanger is communicated with the air inlet of the compressor; at the same time, the pipeline connection of the indoor heat exchanger is disconnected; wherein, refrigerant from the air outlet of the compressor flows sequentially through at least the other of the at least two refrigerant flow paths of the outdoor heat exchanger, the throttling elements, at least one of the at least two refrigerant flow paths of the outdoor heat exchanger, and the air inlet of the compressor.

In addition to one or more of the above features, or as an alternative, in another embodiment, the control method further comprises: a cooling mode or an overall defrosting mode, in which pipeline connections between the first type four-way valve and the second type four-way valve are switched, so that the air outlet of the compressor is respectively communicated with all refrigerant flow paths of the outdoor heat exchanger, and the indoor heat exchanger is communicated with the air inlet of the compressor; wherein, refrigerant from the air outlet of the compressor flows sequentially through all refrigerant flow paths of the outdoor heat exchanger, the throttling elements, the indoor heat exchanger, and the air inlet of the compressor.

In addition to one or more of the above features, or as an alternative, in another embodiment, the control method further comprises: a heating mode, in which pipeline connections between the first type four-way valve and the second type four-way valve are switched, so that the air outlet of the compressor is communicated with the indoor heat exchanger, and all refrigerant flow paths of the outdoor heat exchanger is communicated with the air inlet of the compressor; wherein, refrigerant from the air outlet of the compressor flows sequentially through the indoor heat exchanger, the throttling elements, all refrigerant flow paths of the outdoor heat exchanger, and the air inlet of the compressor.

The heat pump system according to the present application, by using an interlaced heat exchanger having at least two refrigerant flow paths as an outdoor heat exchanger and conducting at least one of the refrigerant flow paths, makes it possible for the heat pump system to achieve local defrosting. In addition, through the flow path design of the system, the heating mode can still be maintained in operation when the heat pump system is in the local defrosting mode, thus avoiding frequent interruptions of heating mode and improving the user experience. Furthermore, due to the structural characteristics of the interlaced heat exchanger, the heat losing in the heat transfer air media and heat transfer metal components can be reduced, thus improving the heat utilization efficiency in the defrosting mode. And, by the corresponding control method, the heat pump system can carry out various local defrosting modes. As a result, targeted defrosting can be performed on some heat exchangers with more severe frosting in outdoor units, which also reduces energy loss.

DETAILED DESCRIPTION OF THE INVENTION

The present application will be described in detail hereinafter with reference to the exemplary embodiments shown in the accompanying drawings. However, it should be understood that the present application can be implemented in many different forms, and should not be construed as being limited to the embodiments set forth herein. These embodiments are provided here for the purpose of making the disclosure of the present application more complete and comprehensive, and fully conveying the concept of the present application to those skilled in the art.

Figure 1:
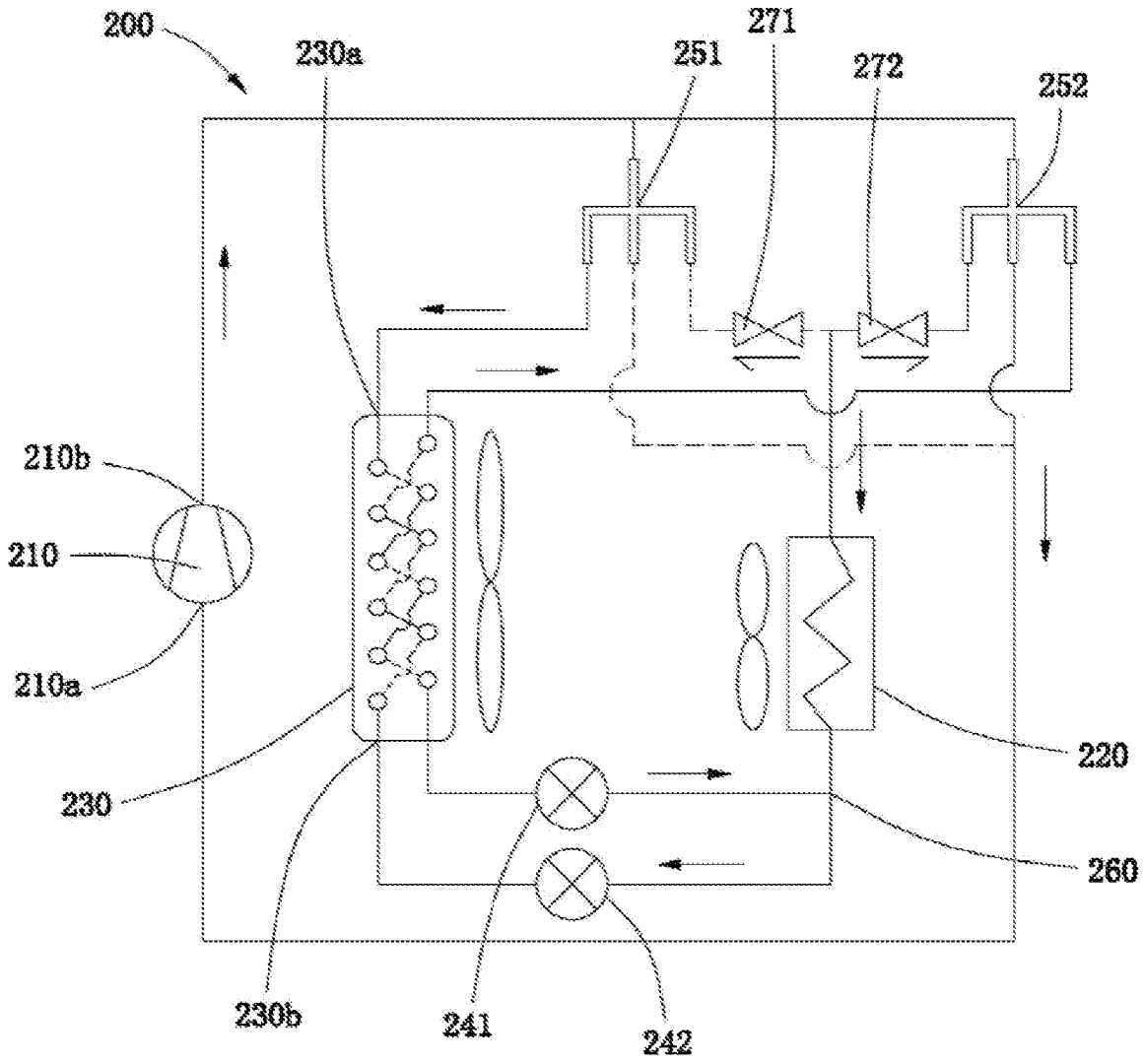
FIG. 1 is a schematic diagram of the system flow direction of an embodiment of the heat pump system of the present invention in a first combined defrosting mode.
Figure 2:
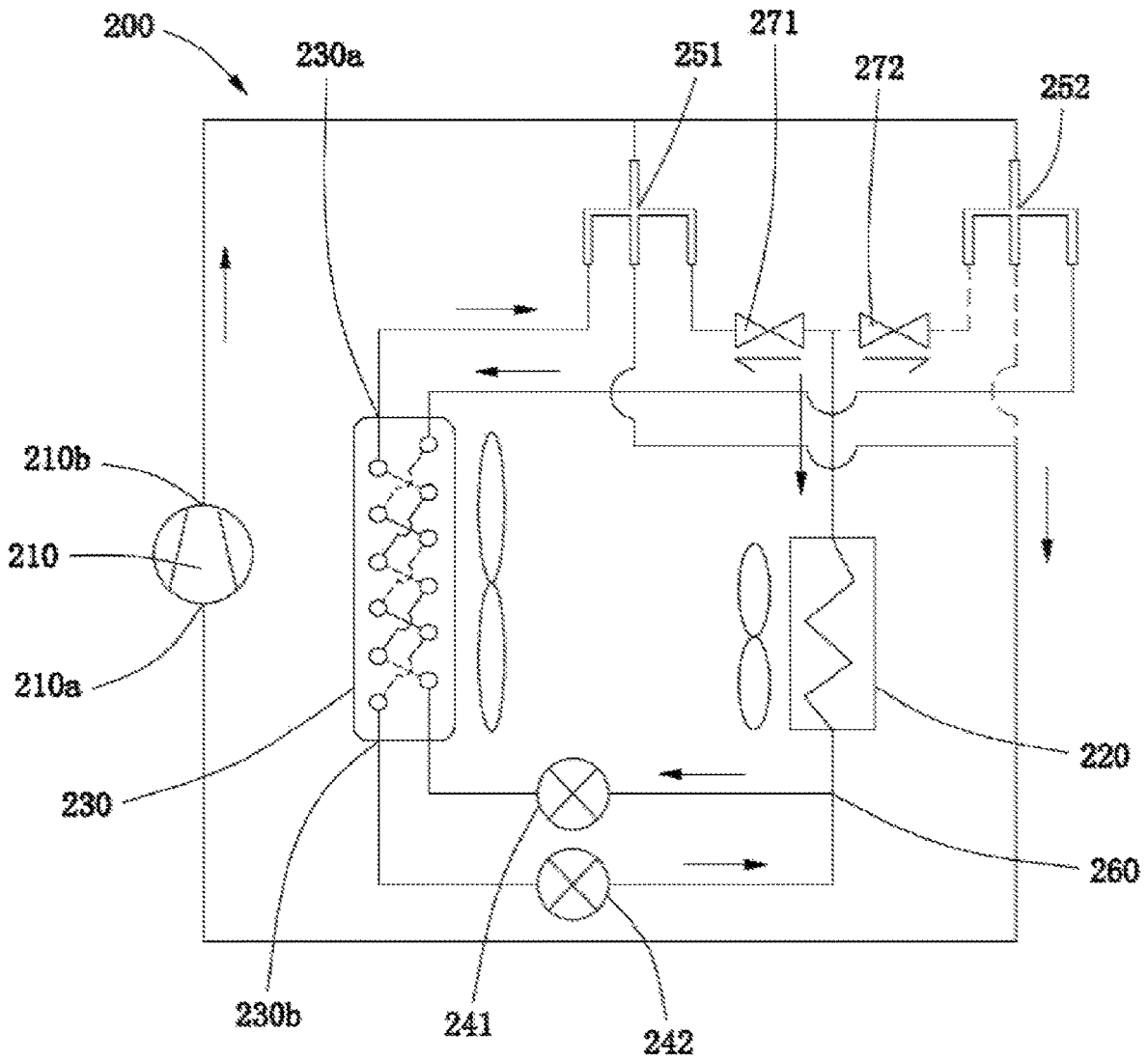
FIG. 2 is a schematic diagram of the system flow direction of an embodiment of the heat pump system of the present invention in a second combined defrosting mode.
Figure 3:
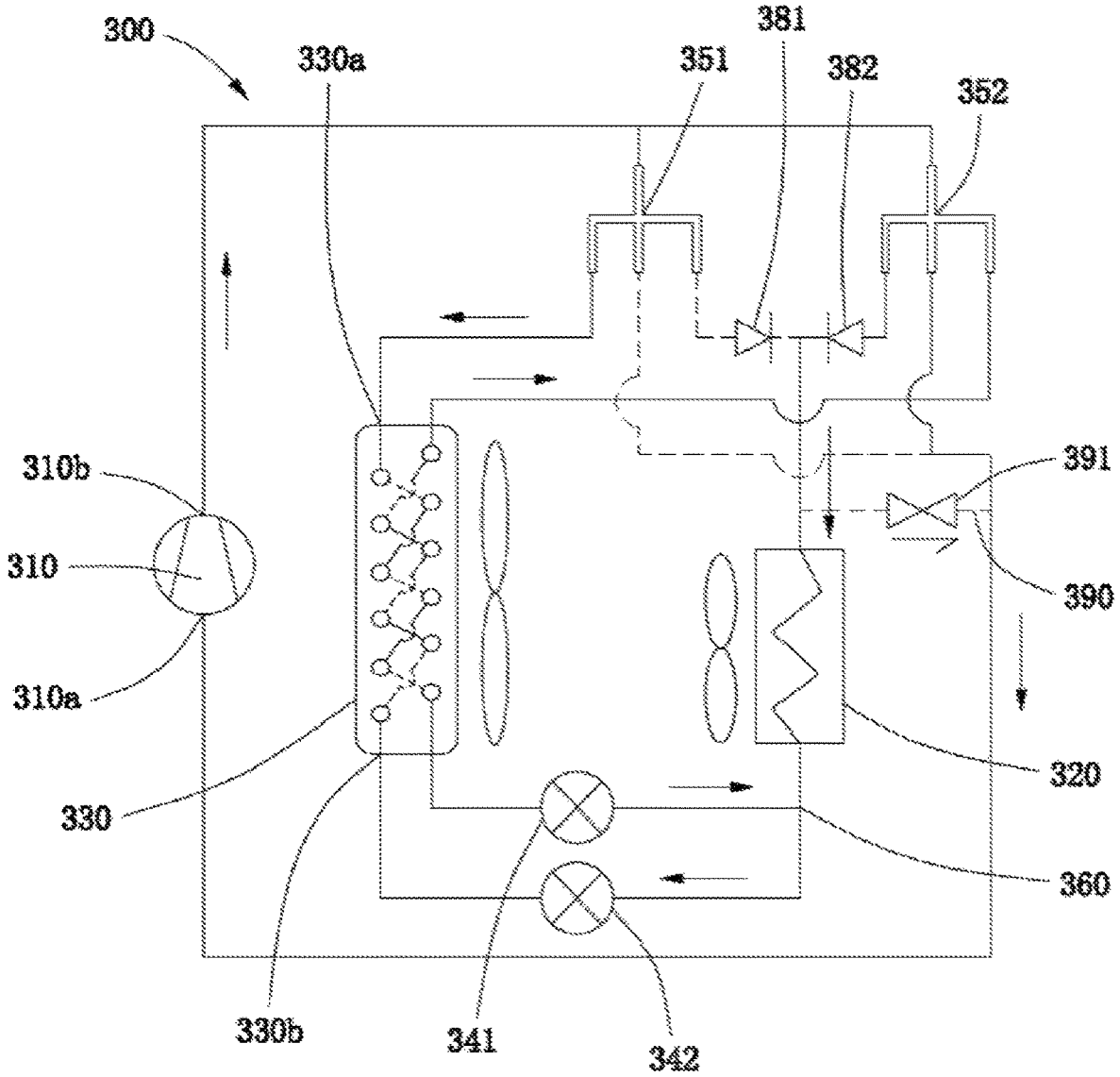
FIG. 3 is a schematic diagram of the system flow direction of another embodiment of the heat pump system of the present invention in the first combined defrosting mode.
Figure 4:
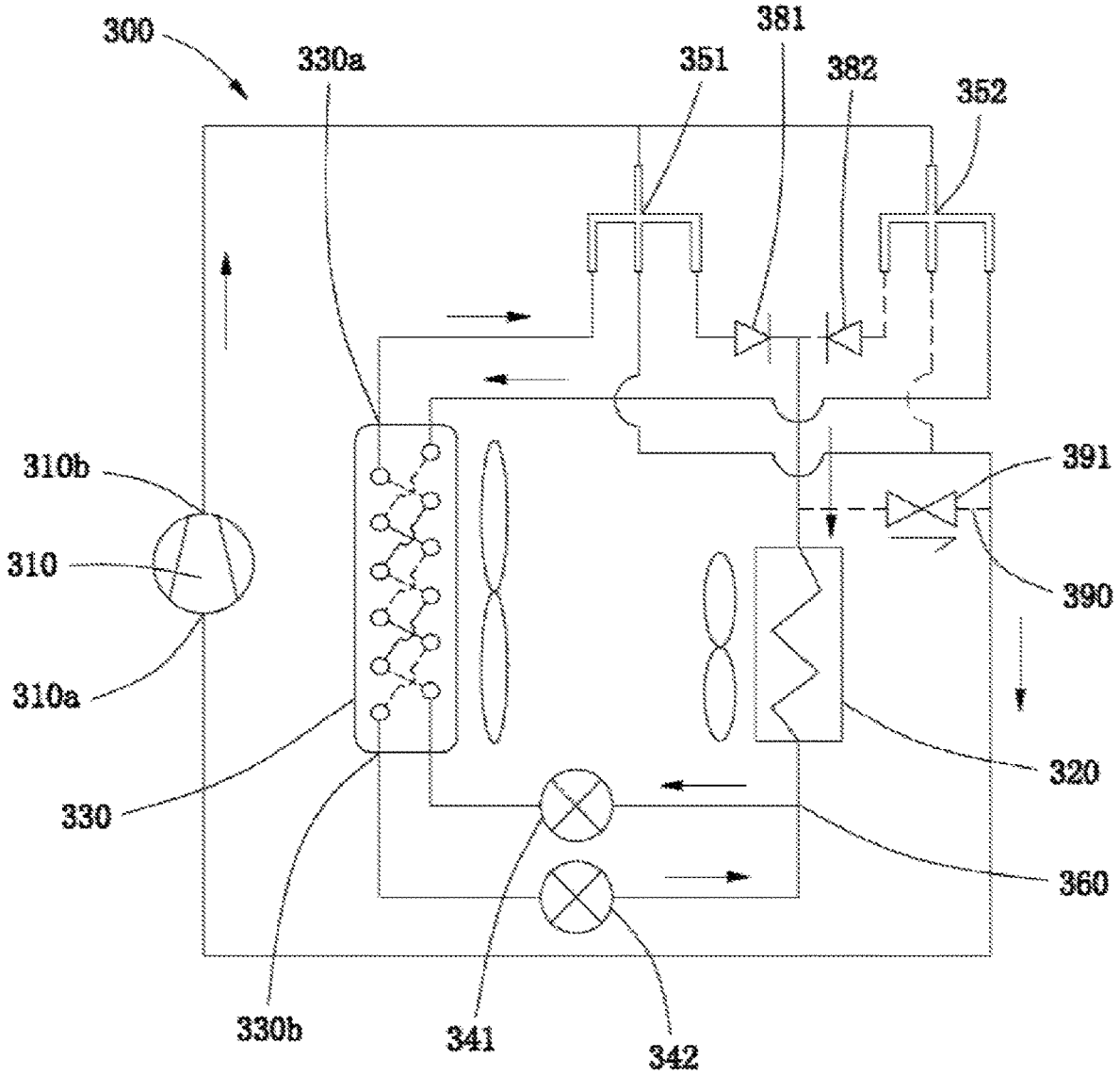
FIG. 4 is a schematic diagram of the system flow direction of another embodiment of the heat pump system of the present invention in the second combined defrosting mode.

Referring to FIGS. 1 to 4, a plurality of embodiments of the heat pump system according to the present application are shown. Wherein, FIGS. 1 to 2 show different operating modes of the first embodiment of the heat pump system, respectively; FIGS. 3 to 4 show different operating modes of the second embodiment of the heat pump system, respectively. Specifically, the flow direction of the refrigerant in the current operating mode is shown with arrows in each of the drawings, and the on-off state of the flow path is indicated by solid and dotted lines connected between the components. The flow path configuration of the corresponding embodiment of the heat pump system will be described below in conjunction with each set of drawings separately, and then each operating mode in the embodiment will be described in conjunction with each of the drawings separately.

With continued reference to FIGS. 1 to 2, as an example of the flow path configuration, the heat pump system 200 comprises a compressor 210 having a refrigerant inlet 210*a* and a refrigerant outlet 210*b*, an indoor heat exchanger 220, an outdoor heat exchanger 230, and throttling elements. Wherein, the outdoor heat exchanger 230 is configured as an interlaced heat exchanger with at least two refrigerant flow paths. A plurality of throttling elements are respectively provided between the indoor heat exchanger 220 and the at least two refrigerant flow paths of the outdoor heat exchanger 230. For example, two throttling elements 241 and 242 are respectively provided between a three-way intersection point 260 and the two refrigerant flow paths 230*a* and 230*b* of the outdoor heat exchanger 230, so as to ensure that the refrigerant will always be throttled at least once in any mode.

In addition, to achieve the switch function of the heat pump system 200 between various operating modes, a corresponding flow path switch valve assembly shall also be provided. The flow path switch valve assembly in this embodiment is a first type four-way valve 251 and a second type four-way valve 252. The four ports of the first type four-way valve 251 are connected to the inlet 210*a* and outlet 210*b* of the compressor 210, the indoor heat exchanger 220, and the first refrigerant flow path 230*a* of the outdoor heat exchanger 230, respectively. The four ports of the second type four-way valve 252 are connected to the inlet 210*a* and the outlet 210*b* of the compressor 210, the indoor heat exchanger 220, and the second refrigerant flow path 230*b* of the outdoor heat exchanger 230, respectively.

Wherein, the aforementioned interlaced heat exchanger is a mature heat exchanger in the field, which usually has at least two refrigerant inlets and at least two refrigerant outlets corresponding to each other. A plurality of refrigerant branches may be provided between each set of refrigerant inlet and outlet. These refrigerant branches between the refrigerant inlet and outlet of the same set jointly constitute the refrigerant flow paths mentioned herein. The interlaced heat exchanger is characterized in that the refrigerant branches in different refrigerant flow paths can be arranged in an interlaced manner. Taking an interlaced heat exchanger with two refrigerant flow paths as an example, several refrigerant branches in the first refrigerant flow path can be arranged close to each other, while the other part of refrigerant branches thereof can be arranged close to several refrigerant branches in the second refrigerant flow path, so that the refrigerant in the two refrigerant flow paths can exchange heat sufficiently.

At this point, in a local defrosting mode, the heat pump system can drive the refrigerant from the outlet of the compressor to flow sequentially through the indoor heat exchanger and at least one of the at least two refrigerant flow paths of the outdoor heat exchanger, and then through the throttling elements, at least the other of the at least two refrigerant flow paths of the outdoor heat exchanger, and the inlet of the compressor.

The heat pump system according to the present application, by using an interlaced heat exchanger with at least two refrigerant flow paths as an outdoor heat exchanger and selectively conducting at least one of the refrigerant flow paths, makes it possible for the heat pump system to achieve local defrosting. In addition, through the flow path design of the system, the heating mode can still be maintained in operation when the heat pump system is in the local defrosting mode, thus avoiding frequent interruptions of the heating mode and improving the user experience. Furthermore, due to the structural characteristics of the interlaced heat exchanger, the heat losing in the heat transfer air media and heat transfer metal components can be reduced, thus improving the heat utilization efficiency in the local defrosting mode. It is also possible to perform targeted defrosting on some heat exchangers with more severe frosting in outdoor units, which also reduces energy loss. And, this flow path arrangement makes local defrosting mode possible with fewer valves, and maintains the indoor heating mode in operation in the local defrosting mode, fully considering the balance of system cost and performance.

Various possible modifications of the heat pump system are described below in conjunction with the accompanying drawings. In addition, some components may be additionally added for further improvement of the energy efficiency or reliability etc. of the system, which are also exemplified below.

For example, in conjunction with FIGS. 1 to 2, although one four-way valve is used to denote the first type four-way valve 251 and the second type four-way valve 252 mentioned above, it is actually intended to represent two types of four-way valves. These two types of four-way valves have roughly the same connection, except that they are connected to different refrigerant flow paths on the outdoor heat exchanger respectively. Considering that there may be more than two refrigerant flow paths in an interlaced heat exchanger, the first type four-way valve 251 or the second type four-way valve 252 can be respectively configured for the exceeding plurality of refrigerant flow paths, so as to ensure that they can operate according to the flow paths arranged. For example, when the solution of flow paths connection of three second type four-way valves 252 are adopted to connect to the system, certain three refrigerant flow paths used in the interlaced heat exchanger have a flow control mode similar to that of the second refrigerant flow path 230*b*. For another example, when the solution of flow paths connection of two first type four-way valves 251 are adopted to connect to the system, certain two refrigerant flow paths used in the interlaced heat exchanger have a flow control mode similar to that of the first refrigerant flow path 230*a*. That is, the flow path arrangement of the heat pump system mentioned in the present invention is also applicable to interlaced heat exchangers with multiple refrigerant flow paths, and part of them can be used for local defrosting through the corresponding flow path arrangement. Similarly, part of the local defrosting modes can be compatible with indoor heating mode.

For another example, several valves may be additionally provided to assist in conducting and switching the flow paths under the system arrangement. For example, the heat pump system 200 in this embodiment also comprises: a first solenoid valve 271 and a second solenoid valve 272. Wherein, the first solenoid valve 271 is arranged between the first type four-way valve 251 and the indoor heat exchanger 220, and the second solenoid valve 272 is arranged between the second type four-way valve 252 and the indoor heat exchanger 220.

Based on the teaching given above, it should be noted that when there are a plurality of first type four-way valves 251 to match a plurality of refrigerant flow paths in an interlaced heat exchanger, a plurality of first solenoid valves 271 can also be arranged accordingly, or a first solenoid valve 271 can be arranged in the common flow path between the plurality of first type four-way valves 251 and the indoor heat exchanger 220. Similarly, when there are a plurality of second type four-way valves 252 to match a plurality of refrigerant flow paths in an interlaced heat exchanger, a plurality of second solenoid valves 272 can also be arranged accordingly, or a second solenoid valve 272 can be arranged in the common flow path between the plurality of second type four-way valves 252 and the indoor heat exchanger 220.

As another example, throttling elements are arranged so that the refrigerant required to flow between two heat exchangers or two parts of a heat exchanger can be throttled and expanded, thus achieving the functions of condensation and heat dissipation and evaporation and heat absorption before and after the expansion throttling, respectively. To this end, one or more throttling elements may be provided in the flow path to achieve this purpose. Referring to the accompanying drawings, two throttling elements are provided in this embodiment, namely, a first throttling element 241 and a second throttling element 242. When the three-way intersection point 260 on the connecting pipeline between the indoor heat exchanger 220 and the two refrigerant flow paths 230*a* and 230*b* of the outdoor heat exchanger 230 is taken as the cut-off point, the first throttling element 241 is arranged between the first refrigerant flow path 230*a* of the outdoor heat exchanger 230 and the three-way intersection point 260; and the second throttling element 242 is arranged between the second refrigerant flow path 230*b* of the outdoor heat exchanger 230 and the three-way intersection point 260. At this point, there is one or two throttling elements between any two heat exchangers or between any two parts of the heat exchanger, so as to achieve the throttling function. In addition, in an embodiment not shown in the figures, three throttling elements may also be provided, that is, a third throttling element is arranged between the indoor heat exchanger 220 and the three-way intersection point 260. Under this arrangement, when conducting the corresponding flow path, both throttling elements in the flow path can play a throttling role, or only one of them can play a throttling role while the other one serves as a valve for conducting the flow path, thus achieving two throttling effects on any flow path with a larger throttling adjustment range. When a plurality of throttling elements are selected to perform throttling or conducting functions, the throttling elements downstream of the flow path after converge should be used for throttling, while the throttling elements on the upstream branch(es) should be kept fully open, otherwise, system reliability problems may arise. When one of the valves is used only for conducting the flow path, the valve can also be selected as the first solenoid valve.

The control method for the heat pump system 200 will be described below in conjunction with FIGS. 1 to 2.

Referring to FIG. 1, a first combined defrosting mode of the heat pump system 200 is shown. At this point, the pipeline connections between the first type four-way valve 251 and the second type four-way valve 252 can be switched, and the second solenoid valve 272 is turned on and the first solenoid valve 271 is turned off, so that the outlet 210*b* of the compressor 210 is respectively communicated with the first refrigerant flow path 230*a* of the outdoor heat exchanger 230 and the indoor heat exchanger 220, and the second refrigerant flow path 230*b* of the outdoor heat exchanger 230 is communicated with the inlet 210*a* of the compressor 210.

At this point, after undergoing gas-phase compression by the compressor 210, a part of refrigerant from the outlet 210*b* of the compressor 210 flows sequentially through the first type four-way valve 251 to the first refrigerant flow path 230*a* of the outdoor heat exchanger 230 for condensation and heat dissipation, thus defrosting the refrigerant flow path pipelines accordingly. Thereafter, after flowing through the fully open first throttling element 241, this part of refrigerant is throttled by the second throttling element 242, and then flows through the second refrigerant flow path 230*b* of the outdoor heat exchanger 230 for evaporation and heat absorption, and finally returns to the inlet 210*a* of the compressor 210 through the second type four-way valve 252, thus completing the cycle of this part of refrigerant. At the same time, another part of the compressed refrigerant from the outlet 210*b* of the compressor 210 flows through the second type four-way valve 252 and the second solenoid valve 272 to the indoor heat exchanger 220 for condensation and heat dissipation, thus providing heating for indoors accordingly. Thereafter, after throttled by a second throttling element 242, this part of refrigerant flows through the second refrigerant flow path 230*b* of the outdoor heat exchanger 230 for evaporation and heat absorption, and then returns to the inlet 210*a* of the compressor 210 through the second type four-way valve 252, thereby completing the cycle of this part of refrigerant.

Accordingly, based on this mode, it is possible that only the local defrosting function is performed, while the heating function is no longer implemented simultaneously, i.e., the first local defrosting mode is performed separately. Specifically, while continuing to use the above four-way valve switch scheme, the first solenoid valve 271 and the second solenoid valve 272 should also be turned off, so as to disconnect the indoor heat exchanger 220 from the flow path.

At this point, after undergoing gas-phase compression by the compressor 210, the refrigerant from the outlet 210*b* of the compressor 210 flows sequentially through the first type four-way valve 251 to the first refrigerant flow path 230*a* of the outdoor heat exchanger 230 for condensation and heat dissipation, thus defrosting the refrigerant flow path pipelines accordingly. Thereafter, after throttled by one or both of the first throttling element 241 and the second throttling element 242, this part of refrigerant flows through the second refrigerant flow path 230*b* of the outdoor heat exchanger 230 for evaporation and heat absorption, and then returns to the inlet 210*a* of the compressor 210 through the second type four-way valve 252, thereby completing the refrigerant cycle.

Referring to FIG. 2, a second combined defrosting mode for the heat pump system 200 is shown. At this point, the pipeline connections between the first type four-way valve 251 and the second type four-way valve 252 can be switched, and the first solenoid valve 271 is turned on and the second solenoid valve 272 is turned off, so that the outlet 210*b* of the compressor 210 is respectively communicated with the second refrigerant flow path 230*b* of the outdoor heat exchanger 230 and the indoor heat exchanger 220, and the first refrigerant flow path 230*a* of the outdoor heat exchanger 230 is communicated with the inlet 210*a* of the compressor 210.

At this point, after undergoing gas-phase compression by the compressor 210, a part of refrigerant from the outlet 210*b* of the compressor 210 flows sequentially through the second type four-way valve 252 to the second refrigerant flow path 230*b* of the outdoor heat exchanger 230 for condensation and heat dissipation, thus defrosting the refrigerant flow path pipelines accordingly. Thereafter, after flowing through the fully open second throttling element 242, this part of refrigerant is throttled in the first throttling element 241, and then flows through the first refrigerant flow path 230*a* of the outdoor heat exchanger 230 for evaporation and heat absorption, and finally returns to the inlet 210*a* of the compressor 210 through the first type four-way valve 251, thus completing the cycle of this part of refrigerant. At the same time, another part of compressed refrigerant from the outlet 210*b* of the compressor 210 flows sequentially through the first type four-way valve 251 and the first solenoid valve 271 to the indoor heat exchanger 220 for condensation and heat dissipation, thus providing heating for indoors accordingly. Thereafter, after throttled by the first throttling element 241, this part of refrigerant flows through the first refrigerant flow path 230*a* of the outdoor heat exchanger 230 for evaporation and heat absorption, and then returns to the inlet 210*a* of the compressor 210 through the first type four-way valve 251, thus completing the cycle of this part of refrigerant.

Accordingly, based on this mode, it is possible that only the local defrosting function is performed, while the heating function is no longer implemented simultaneously, i.e., the second local defrosting mode is performed separately. Specifically, while continuing to use the above four-way valve switch scheme, the first solenoid valve 271 and the second solenoid valve 272 should also be turned off, so as to disconnect the indoor heat exchanger 220 from the flow path.

Under the above system arrangement, local targeted defrosting can first be achieved. In addition, heating operation of the indoor heat exchanger can be maintained in operation in both combined defrosting modes, that is, the heating and defrosting modes of the whole system can run uninterrupted, which improves the user experience. Accordingly, several valves need to be additionally arranged in the flow path of the system and valve control logic is also configured accordingly to control the on-off and change of direction of the flow path, thus making it better applicable in occasions where more attention is paid to the user experience.

Of course, in another embodiment where a third throttling element not shown in the figures is additionally arranged, the heat pump system can also achieve the local targeted defrosting mode for different refrigerant flow paths of the outdoor heat exchanger without taking heat from indoors. At this point, the third throttling element needs to be completely shut off, while the other components perform similar actions as described above. At this time, although the heating operation of the indoor heat exchanger is not maintained in operation, such mode can improve the indoor comfort to a certain extent compared with the conventional defrosting mode which takes heat from indoors.

Of course, the heat pump system can also achieve the conventional cooling mode, heating mode and overall defrosting mode (i.e., to reversely run the cooling mode in the heating mode). Although the flow direction is not shown in the figures, an illustrative description can still be made in conjunction with the system arrangement schemes in FIGS. 1 and 2.

According to one aspect, in the cooling mode (or the overall defrosting mode), the pipeline connections between the first type four-way valve 251 and the second type four-way valve 252 can be switched, and at least one of the first solenoid valve 271 and the second solenoid valve 272 is turned on, so that the outlet 210*b* of the compressor 210 is respectively communicated with the first refrigerant flow path 230*a* and the second refrigerant flow path 230*b* of the outdoor heat exchanger 230, and the indoor heat exchanger 220 is communicated with the inlet 210*a* of the compressor 210.

At this point, after undergoing gas-phase compression by the compressor 210, a part of refrigerant from the outlet 210*b* of the compressor 210 flows through the first type four-way valve 251 to the first refrigerant flow path 230*a* of the outdoor heat exchanger 230 for condensation and heat dissipation (or in the overall defrosting mode, the refrigerant flow path pipelines are defrosted accordingly). Thereafter, after throttled by the first throttling element 241, this part of refrigerant flows through the indoor heat exchanger 220 for evaporation and heat absorption, and then returns to the inlet 210*a* of the compressor 210 through the first type four-way valve 251 and/or the second type four-way valve 252, thus completing the cycle of this part of refrigerant. At the same time, another part of the compressed refrigerant from the outlet 210*b* of the compressor 210 flows through the second type four-way valve 252 to the second refrigerant flow path 230*b* of the outdoor heat exchanger 230 for condensation and heat dissipation (or in the overall defrosting mode, the refrigerant flow path pipelines are defrosted accordingly). Thereafter, after throttled by the second throttling element 242, this part of refrigerant flows through the indoor heat exchanger 220 for evaporation and heat absorption, and then returns to the inlet 210*a* of the compressor 210 through the first type four-way valve 251 and/or the second type four-way valve 252, thereby completing the cycle of this part of refrigerant.

According to another aspect, in the heating mode, the pipeline connections between the first type four-way valve 251 and the second type four-way valve 252 can be switched, and at least one of the first solenoid valve 271 and the second solenoid valve 272 is turned on, so that the outlet 210*b* of the compressor 210 is communicated with the indoor heat exchanger 220, and the inlet 210*a* of the compressor 210 is respectively communicated with the first refrigerant flow path 230*a* and the second refrigerant flow path 230*b* of the outdoor heat exchanger 230.

At this point, after undergoing gas-phase compression by the compressor 210, the refrigerant from the outlet 210*b* of the compressor 210 flows through the first type four-way valve 251 and/or the second type four-way valve 252 to the indoor heat exchanger 220 for condensation and heat dissipation, thus providing heating for indoors accordingly. Thereafter, after throttled by the first throttling element 241, a part of refrigerant flows through the first refrigerant flow path 230*a* of the outdoor heat exchanger 230 for evaporation and heat absorption, and then returns to the inlet 210*a* of the compressor 210 through the first type four-way valve 251, thus completing the cycle of this part of refrigerant. At the same time, after throttled by the second throttling element 242, the other part of the refrigerant flows through the second refrigerant flow path 230*b* of the outdoor heat exchanger 230 for evaporation and heat absorption, and then returns to the inlet 210*a* of the compressor 210 through the second type four-way valve 252, thereby completing the cycle of this part of refrigerant.

Various possible flow path configurations for this type of heat pump systems will be further described below in conjunction with other embodiments in FIGS. 3 to 4. To achieve different flow path configurations, it is possible to directly change part of the pipeline connection points, or to change part of the flow direction of flow path through various valves or combinations of the valves.

Specifically, referring to FIGS. 3 to 4, as another example of the flow path configuration, the heat pump system 300 comprises a compressor 310 having an inlet 310*a* and an outlet 310*b*, an indoor heat exchanger 320, an outdoor heat exchanger 330, and throttling elements. Wherein, the outdoor heat exchanger 330 is configured as an interlaced heat exchanger with at least two refrigerant flow paths. A plurality of throttling elements 341 and 342 are respectively provided between the indoor heat exchanger 320 and the at least two refrigerant flow paths 330*a* and 330*b* of the outdoor heat exchanger 230. For example, two throttling elements 341 and 342 are respectively provided between a three-way intersection point 360 and the two refrigerant flow paths 330*a* and 330*b* of the outdoor heat exchanger 330, so as to ensure that the refrigerant will always be throttled at least once in any mode.

Similarly, to achieve the switch function of the heat pump system 300 between various operating modes, a corresponding flow path switch valve assembly shall also be provided. The flow path switch valve assembly in this embodiment is also a first type four-way valve 351 and a second type four-way valve 352. The four ports of the first type four-way valve 351 are connected to the inlet 310*a* and outlet 310*b* of the compressor 310, the indoor heat exchanger 320, and the first refrigerant flow path 330*a* of the outdoor heat exchanger 330, respectively. The four ports of the second type four-way valve 352 are connected to the inlet 310*a* and the outlet 310*b* of the compressor 310, the indoor heat exchanger 320, and the second refrigerant flow path 330*b* of the outdoor heat exchanger 330, respectively.

The aforementioned arrangement is similar to the embodiment shown in FIGS. 1 to 2. One difference is that it has modified the valves that are arranged to aid in conducting and switching the flow path under such system arrangement, so that only one solenoid valve required to be controlled is remained, while the on-off at other locations are achieved using check valves. At this point, the heat pump system 300 in this embodiment also comprises: a first check valve 381, a second check valve 382, and a third solenoid valve 391. Wherein, the first check valve 381 is arranged between the first type four-way valve 351 and the indoor heat exchanger 320, and the second check valve 382 is arranged between the second type four-way valve 352 and the indoor heat exchanger 320. A bypass branch 390 is further provided, with a first end thereof connected to the common flow path between the first check valve 381, the second check valve 382 and the indoor heat exchanger 320, and a second end thereof connected to the inlet 310*a* of the compressor 310. The third solenoid valve 391 is arranged on the bypass branch 390.

Based on the teaching given above, it should be noted that when there are a plurality of first type four-way valves 351 to match a plurality of refrigerant flow paths in an interlaced heat exchanger, a plurality of first check valves 381 can also be arranged accordingly, or a first check valve 381 can be arranged in the common flow path between the plurality of first type four-way valves 351 and the indoor heat exchanger 320. Similarly, when there are a plurality of second type four-way valves 352 to match a plurality of refrigerant flow paths in an interlaced heat exchanger, a plurality of second check valves 382 can also be arranged accordingly, or a second check valve 382 can be arranged in the common flow path between the plurality of second type four-way valves 352 and the indoor heat exchanger 320. In addition, for the same reason, one or more bypass branches 390 may be provided, with a third solenoid valve 391 provided thereon.

Also based on the principle of arranging throttling elements as mentioned above, two throttling elements are provided in this embodiment, namely, a first throttling element 341 and a second throttling element 342. When the three-way intersection point 360 on the connecting pipeline between the indoor heat exchanger 320 and the two refrigerant flow paths 330*a* and 330*b* of the outdoor heat exchanger 330 is taken as the cut-off point, the first throttling element 341 is arranged between the first refrigerant flow path 330*a* of the outdoor heat exchanger 330 and the three-way intersection point 360; and the second throttling element 342 is arranged between the second refrigerant flow path 330*b* of the outdoor heat exchanger 330 and the three-way intersection point 360. At this point, there are one or two throttling elements between any two heat exchangers or between any two parts of the heat exchanger, so as to achieve the throttling function. In addition, in an embodiment not shown in the figures, three throttling elements may also be provided, that is, a third throttling element is arranged between the indoor heat exchanger 320 and the three-way intersection point 360. Under this arrangement, when conducting the corresponding flow path, both throttling elements in the flow path can play a throttling role, or only one of them can play a throttling role while the other one serves as a valve for conducting the flow path, thus achieving two throttling effects on any flow path with a larger throttling adjustment range. When a plurality of throttling elements are selected to perform throttling or conducting functions, the throttling elements downstream of the flow path after converge should be used for throttling, while the throttling elements on the upstream branch(es) should be kept fully open, otherwise, system reliability problems may arise. When one of the valves is used only for conducting the flow path, the valve can also be selected as the first solenoid valve.

The control method for the heat pump system 300 will be described below in conjunction with FIGS. 3 to 4.

Referring to FIG. 3, a first combined defrosting mode of the heat pump system 300 is shown. At this point, the pipeline connections between the first type four-way valve 351 and the second type four-way valve 352 can be switched, and the third solenoid valve 391 is turned off, so that the outlet 310*b* of the compressor 310 is respectively communicated with the first refrigerant flow path 330*a* of the outdoor heat exchanger 330 and the indoor heat exchanger 320, and the second refrigerant flow path 330*b* of the outdoor heat exchanger 330 is communicated with the inlet 310*a* of the compressor 310.

At this point, after undergoing gas-phase compression by the compressor 310, a part of refrigerant from the outlet 310*b* of the compressor 310 flows sequentially through the first type four-way valve 351 to the first refrigerant flow path 330*a* of the outdoor heat exchanger 330 for condensation and heat dissipation, thus defrosting the refrigerant flow path pipelines accordingly. Thereafter, after flowing through the fully open throttling element 341, this part of refrigerant is throttled by the second throttling element 342, and then flows through the second refrigerant flow path 330*b* of the outdoor heat exchanger 330 for evaporation and heat absorption, and finally returns to the inlet 310*a* of the compressor 310 through the second type four-way valve 352, thus completing the cycle of this part of refrigerant. At the same time, another part of the compressed refrigerant from the outlet 310*b* of the compressor 310 flows through the second type four-way valve 352 and the second check valve 382 to the indoor heat exchanger 320 for condensation and heat dissipation, thus providing heating for indoors accordingly. Thereafter, after throttled by the second throttling element 342, this part of refrigerant flows through the second refrigerant flow path 330*b* of the outdoor heat exchanger 330 for evaporation and heat absorption, and then returns to the inlet 310*a*of the compressor 310 through the second type four-way valve 352, thereby completing the cycle of this part of refrigerant.

Accordingly, based on this mode, it is possible that only the local defrosting function is performed, while the heating function is no longer implemented simultaneously, i.e., the first local defrosting mode is performed separately. Specifically, while continuing to use the above four-way valve switch scheme, a valve for controlling on-off shall be added to the flow path where the indoor heat exchanger 320 is located, which is turned off, so as to disconnect the indoor heat exchanger 320 from the flow path.

At this point, after undergoing gas-phase compression by the compressor 310, the refrigerant from the outlet 310*b* of the compressor 310 flows sequentially through the first type four-way valve 351 to the first refrigerant flow path 330*a* of the outdoor heat exchanger 330 for condensation and heat dissipation, thus defrosting the refrigerant flow path pipelines accordingly. Thereafter, after throttled by one or both of the first throttling element 341 and the second throttling element 342, this part of refrigerant flows through the second refrigerant flow path 330*b* of the outdoor heat exchanger 330 for evaporation and heat absorption, and then returns to the inlet 310*a* of the compressor 310 through the second type four-way valve 352, thus completing the refrigerant cycle.

Referring to FIG. 4, a second combined defrosting mode for the heat pump system 300 is shown. At this point, the pipeline connections between the first type four-way valve 351 and the second type four-way valve 352 can be switched, and the third solenoid valve 391 is turned off, so that the outlet 310*b* of the compressor 310 is respectively communicated with the second refrigerant flow path 330*b* of the outdoor heat exchanger 330 and the indoor heat exchanger 320, and the first refrigerant flow path 330*a* of the outdoor heat exchanger 330 is communicated with the inlet 310*a* of the compressor 310.

At this point, after undergoing gas phase compression by the compressor 310, a part of the refrigerant from the outlet 310*b* of the compressor 310 flows sequentially through the second type four-way valve 352 to the second refrigerant flow path 330*b* of the outdoor heat exchanger 330 for condensation and heat dissipation, thus defrosting the refrigerant flow path pipelines accordingly. Thereafter, after flowing through the fully open second throttling element 342, this part of refrigerant is throttled by the first throttling element 341, and then flows through the first refrigerant flow path 330*a* of the outdoor heat exchanger 330 for evaporation and heat absorption, and finally returns to the inlet 310*a* of the compressor 310 through the first type four-way valve 351, thus completing the cycle of this part of refrigerant. At the same time, another part of the compressed refrigerant from the outlet 310*b* of the compressor 310 flows through the first type four-way valve 351 and the first check valve 381 to the indoor heat exchanger 320 for condensation and heat dissipation, thus providing heating for indoors accordingly. Thereafter, after throttled by the first throttling element 341, this part of refrigerant flows through the first refrigerant flow path 330*a* of the outdoor heat exchanger 330 for evaporation and heat absorption, and then returns to the inlet 310*a* of the compressor 310 through the first type four-way valve 351, thereby completing the cycle of this part of refrigerant.

Accordingly, based on this mode, it is possible that only the local defrosting function is performed, while the heating function is no longer implemented simultaneously, i.e., the second local defrosting mode is performed separately. Specifically, while continuing to use the above four-way valve switch scheme, a valve for controlling on-off shall be added to the flow path where the indoor heat exchanger 320 is located, which is turned off, so as to disconnect the indoor heat exchanger 320 from the flow path.

At this point, after undergoing gas phase compression by the compressor 310, the refrigerant from the outlet 310*b* of the compressor 310 flows sequentially through the second type four-way valve 352 to the second refrigerant flow path 330*b* of the outdoor heat exchanger 330 for condensation and heat dissipation, thus defrosting the refrigerant flow path pipelines accordingly. Thereafter, after throttled by one or both of the first throttling element 341 and the second throttling element 342, this part of refrigerant flows through the first refrigerant flow path 330*a* of the outdoor heat exchanger 330 for evaporation and heat absorption, and then returns to the inlet 310*a* of the compressor 310 through the first type four-way valve 351, thereby completing the cycle of this part of refrigerant.

Under the above system arrangement, local targeted defrosting can first be achieved. In addition, heating operation of the indoor heat exchanger can be maintained in operation in both combined defrosting modes, that is, the heating and defrosting modes of the whole system can run uninterrupted, which improves the user experience. Accordingly, several valves need to be additionally arranged in the flow path of the system and valve control logic is also configured accordingly to control the on-off and change of direction of the flow path, thus making it better applicable in occasions where more attention is paid to the user experience.

Of course, in another embodiment where a third throttling element not shown in the figures is additionally arranged, the heat pump system can also achieve the local targeted defrosting mode for different refrigerant flow paths of the outdoor heat exchanger without taking heat from indoors. At this point, the third throttling element needs to be completely shut off, while the other components perform similar actions as described above. At this time, although the heating operation of the indoor heat exchanger is not maintained in operation, such mode can improve the indoor comfort to a certain extent compared with the conventional defrosting mode which takes heat from indoors.

Of course, the heat pump system can also achieve the conventional cooling mode, heating mode and overall defrosting mode (i.e., to reversely run the cooling mode in the heating mode). Although the flow direction is not shown in the figures, an illustrative description can still be made in conjunction with the system arrangement schemes in FIGS. 3 and 4.

According to one aspect, in the cooling mode (or the overall defrosting mode), the pipeline connections between the first type four-way valve 351 and the second type four-way valve 352 can be switched, and the third solenoid valve 391 on the bypass branch 390 is turned on, so that the outlet 310*b* of the compressor 310 is communicated with the first refrigerant flow path 330*a* and the second refrigerant flow path 330*b* of the outdoor heat exchanger 330 respectively, and the indoor heat exchanger 320 is communicated with the inlet 310*a* of the compressor 310.

At this point, after undergoing gas phase compression by the compressor 310, a part of the refrigerant from the outlet 310*b* of the compressor 310 flows sequentially through the first type four-way valve 351 to the first refrigerant flow path 330*a* of the outdoor heat exchanger 330 for condensation and heat dissipation (or, in the overall defrosting mode, the refrigerant flow path pipelines are defrosted accordingly). Thereafter, after throttled by the first throttling element 341, this part of refrigerant flows through the indoor heat exchanger 320 for evaporation and heat absorption, thus providing cooling for indoors accordingly, and finally returns to the inlet 310*a* of the compressor 310 through the bypass branch 390, thus completing the cycle of this part of refrigerant. At the same time, another part of the compressed refrigerant from the outlet 310*b* of the compressor 310 flows sequentially through the second type four-way valve 352 to the second refrigerant flow path 330*b* of the outdoor heat exchanger 330 for condensation and heat dissipation (or, in the overall defrosting mode, the refrigerant flow path pipelines are defrosted accordingly). Thereafter, after throttled by the second throttling element 342, this part of refrigerant flows through the indoor heat exchanger 320 for evaporation and heat absorption, thus providing cooling for indoors accordingly, and finally returns to the inlet 310*a* of the compressor 310 through the bypass branch 390, thus completing the cycle of this part of refrigerant.

According to another aspect, in the heating mode, the pipeline connections between the first type four-way valve 351 and the second type four-way valve 352 can be switched, and the third solenoid valve 391 on the bypass branch 390 can be turned off, so that the outlet 310*b* of the compressor 310 is communicated with the indoor heat exchanger 330, and the inlet 310*a* of the compressor 310 is communicated with the first refrigerant flow path 330*a* and the second refrigerant flow path 330*b* of the outdoor heat exchanger 330 respectively.

At this point, after undergoing gas-phase compression by the compressor 310, the refrigerant from the outlet 310*b* of the compressor 310 flows through the first type four-way valve 351 and the second type four-way valve 352 to the indoor heat exchanger 320 for condensation and heat dissipation, thus providing heating for indoors accordingly. Thereafter, after throttled by the first throttling element 341, a part of refrigerant flows through the first refrigerant flow path 330*a* of the outdoor heat exchanger 330 for evaporation and heat absorption, and then returns to the inlet 310*a* of the compressor 310 through the first type four-way valve 351, thus completing the cycle of this part of refrigerant. At the same time, after throttled by the second throttling element 342, the other part of the refrigerant flows through the second refrigerant flow path 330*b* of the outdoor heat exchanger 330 for evaporation and heat absorption, and then returns to the inlet 310*a* of the compressor 310 through the second type four-way valve 352, thereby completing the cycle of this part of refrigerant.

It should be appreciated that although the embodiments of the control method for the heat pump system is described in a certain order, these steps are not necessarily performed in the order described. Unless explicitly stated herein, there is no strict restriction in terms of the order of carrying out these steps. Instead, these steps can be carried out in other order. In addition, at least one part of the steps of the method may include multiple sub-steps or stages, which may not necessarily be executed at the same time but may be executed at different times, and may not necessarily be executed sequentially but may be executed in turn or alternately with other steps or the sub-steps of other steps or at least one part of stages.

The above examples mainly illustrate a heat pump system and a control method thereof according to the present invention. Although only some of the embodiments of the present invention are described, those skilled in the art should understand that the present invention can, without departing from the spirit and scope of the present invention, be implemented in many other forms. Therefore, the illustrated examples and embodiments are to be considered as illustrative but not restrictive, and the present invention may cover various modifications or replacements if not departed from the spirit and scope of the present invention as defined by the appended claims.

What is claimed is:

1. A heat pump system, comprising:

a compressor having an inlet and an outlet;

an indoor heat exchanger;

an outdoor heat exchanger configured as an interlaced heat exchanger having at least two refrigerant flow paths;

a plurality of throttling elements respectively arranged between any two of the indoor heat exchanger and the at least two refrigerant flow paths of the outdoor heat exchanger; and a first type four-way valve and a second type four-way valve, with at least one port of the first type four-way valve and at least one port of the second type four-way valve are each respectively connected to the inlet and the outlet of the compressor, the indoor heat exchanger, and one of the at least two refrigerant flow paths of the outdoor heat exchanger;

wherein, in a local defrosting mode, two paths of refrigerant from the outlet of the compressor flow respectively through the indoor heat exchanger and at least one of the at least two refrigerant flow paths of the outdoor heat exchanger, and then sequentially through the throttling elements, at least the other of the at least two refrigerant flow paths of the outdoor heat exchanger, and the inlet of the compressor;

wherein in a first combined defrosting mode, connections between the first type four-way valve and the second type four-way valve are switched, so that the outlet of the compressor is communicated with at least one of the at least two refrigerant flow paths of the outdoor heat exchanger and the indoor heat exchanger, and at least the other of the at least two refrigerant flow paths of the outdoor heat exchanger is communicated with the inlet of the compressor; wherein, refrigerant from the outlet of the compressor flows sequentially through at least one of the at least two refrigerant flow paths of the outdoor heat exchanger, the throttling elements, at least the other of the at least two refrigerant flow paths of the outdoor heat exchanger, and the inlet of the compressor; and at the same time, refrigerant from the outlet of the compressor flows sequentially through the indoor heat exchanger, one of the throttling elements, at least the other of the at least two refrigerant flow paths of the outdoor heat exchanger, and the inlet of the compressor; or wherein in a second combined defrosting mode, connections between the first type four-way valve and the second type four-way valve are switched, so that the outlet of the compressor is communicated with at least the other of the at least two refrigerant flow paths of the outdoor heat exchanger and the indoor heat exchanger respectively, and at least one of the at least two refrigerant flow paths of the outdoor heat exchanger is communicated with the inlet of the compressor; wherein, refrigerant from the outlet of the compressor flows sequentially through the other of the at least two refrigerant flow paths of the outdoor heat exchanger, the throttling elements, at least one of the at least two refrigerant flow paths of the outdoor heat exchanger, and the inlet of the compressor; and at the same time, refrigerant from the outlet of the compressor flows sequentially through the indoor heat exchanger, one of the throttling elements, at least one of the at least two refrigerant flow paths of the outdoor heat exchanger, and the inlet of the compressor; or wherein in a first local defrosting mode, connections between the first type four-way valve and the second type four-way valve are switched, so that the outlet of the compressor is communicated with at least one of the at least two refrigerant flow paths of the outdoor heat exchanger, and at least the other of the at least two refrigerant flow paths of the outdoor heat exchanger is communicated with the inlet of the compressor; and at the same time, the pipeline connection of the indoor heat exchanger is disconnected; wherein, refrigerant from the outlet of the compressor flows sequentially through at least one of the at least two refrigerant flow paths of the outdoor heat exchanger, the throttling elements, at least the other of the at least two refrigerant flow paths of the outdoor heat exchanger, and the inlet of the compressor; or wherein in a second local defrosting mode, connections between the first type four-way valve and the second type four-way valve are switched, so that the outlet of the compressor is communicated with at least the other of the at least two refrigerant flow paths of the outdoor heat exchanger, and at least one of the at least two refrigerant flow paths of the outdoor heat exchanger is communicated with the inlet of the compressor; and at the same time, the pipeline connection of the indoor heat exchanger is disconnected; wherein, refrigerant from the outlet of the compressor flows sequentially through the other of the at least two refrigerant flow paths of the outdoor heat exchanger, the throttling elements, at least one of the at least two refrigerant flow paths of the outdoor heat exchanger, and the inlet of the compressor.

2. The heat pump system according to claim 1, wherein the plurality of throttling elements comprise a first throttling element and a second throttling element; a three-way intersection point is provided on connecting pipelines between the indoor heat exchanger and the two refrigerant flow paths of the outdoor heat exchanger; wherein, the first throttling element is arranged on a first connecting pipeline between the three-way intersection point and the outdoor heat exchanger or the indoor heat exchanger; the second throttling element is arranged on a second connecting pipeline between the three-way intersection point and the outdoor heat exchanger or the indoor heat exchanger.

3. The heat pump system according to claim 2, wherein the plurality of throttling elements further comprise a first valve capable of controlling at least on-off of a flow path of the heat pump system; wherein, the first valve is arranged on a third connecting pipeline between the three-way intersection point and the outdoor heat exchanger or the indoor heat exchanger.

4. The heat pump system according to claim 3, wherein the first valve is configured as a third throttling element or a first solenoid valve.

5. The heat pump system according to claim 4, wherein when the first valve is configured as a third throttling element, in a local defrosting mode, refrigerant flows through two of the first throttling element, the second throttling element, and the third throttling element.

6. The heat pump system according to claim 1, further comprising:

a first solenoid valve arranged between the first type four-way valve and the indoor heat exchanger; and a second solenoid valve arranged between the second type four-way valve and the indoor heat exchanger.

7. The heat pump system according to claim 1, wherein:

in a first combined defrosting mode, refrigerant from the outlet of the compressor flows sequentially through at least one of the at least two refrigerant flow paths of the outdoor heat exchanger, the throttling elements, at least the other of the at least two refrigerant flow paths of the outdoor heat exchanger, and the inlet of the compressor; and at the same time, refrigerant from the outlet of the compressor flows sequentially through the indoor heat exchanger, one of the throttling elements, at least the other of the at least two refrigerant flow paths of the outdoor heat exchanger, and the inlet of the compressor; or, in a second combined defrosting mode, refrigerant from the outlet of the compressor flows sequentially through at least the other of the at least two refrigerant flow paths of the outdoor heat exchanger, the throttling elements, at least one of the at least two refrigerant flow paths of the outdoor heat exchanger, and the inlet of the compressor; and at the same time, refrigerant from the outlet of the compressor flows sequentially through the indoor heat exchanger, one of the throttling elements, at least one of the at least two refrigerant flow paths of the outdoor heat exchanger, and the inlet of the compressor.

8. The heat pump system according to claim 1, wherein:

in a first local defrosting mode, refrigerant from the outlet of the compressor flows sequentially through at least one of the at least two refrigerant flow paths of the outdoor heat exchanger, the throttling elements, at least the other of the at least two refrigerant flow paths of the outdoor heat exchanger, and the inlet of the compressor; or, in a second local defrosting mode, refrigerant from the outlet of the compressor flows sequentially through at least the other of the at least two refrigerant flow paths of the outdoor heat exchanger, the throttling elements, at least one of the at least two refrigerant flow paths of the outdoor heat exchanger, and the inlet of the compressor.

9. The heat pump system according to claim 1:

wherein in a cooling mode or an overall defrosting mode, connections between the first type four-way valve and the second type four-way valve are switched, so that the outlet of the compressor is communicated with all refrigerant flow paths of the outdoor heat exchanger respectively, and the indoor heat exchanger is communicated with the inlet of the compressor; wherein, refrigerant from the outlet of the compressor flows sequentially through all refrigerant flow paths of the outdoor heat exchanger, the throttling elements, the indoor heat exchanger, and the inlet of the compressor.

10. The heat pump system according to claim 1:

wherein in a heating mode, connections between the first type four-way valve and the second type four-way valve are switched, so that the outlet of the compressor is communicated with the indoor heat exchanger, and all refrigerant flow paths of the outdoor heat exchanger is communicated with the inlet of the compressor; wherein, refrigerant from the outlet of the compressor flows sequentially through the indoor heat exchanger, the throttling elements, all refrigerant flow paths of the outdoor heat exchanger, and the inlet of the compressor.

11. A heat pump system, comprising:

a compressor having an inlet and an outlet;

an indoor heat exchanger;

an outdoor heat exchanger configured as an interlaced heat exchanger having at least two refrigerant flow paths;

a plurality of throttling elements respectively arranged between any two of the indoor heat exchanger and the at least two refrigerant flow paths of the outdoor heat exchanger; and a first type four-way valve and a second type four-way valve, with at least one port of the first type four-way valve and at least one port of the second type four-way valve are each respectively connected to the inlet and the outlet of the compressor, the indoor heat exchanger, and one of the at least two refrigerant flow paths of the outdoor heat exchanger;

wherein, in a local defrosting mode, two paths of refrigerant from the outlet of the compressor flow respectively through the indoor heat exchanger and at least one of the at least two refrigerant flow paths of the outdoor heat exchanger, and then sequentially through the throttling elements, at least the other of the at least two refrigerant flow paths of the outdoor heat exchanger, and the inlet of the compressor;

a first check valve arranged between the first type four-way valve and the indoor heat exchanger;

a second check valve arranged between the second type four-way valve and the indoor heat exchanger; and a bypass branch, with a first end thereof connected to a common flow path between the first check valve, the second check valve and the indoor heat exchanger, and a second end thereof connected to the inlet of the compressor; wherein, a third solenoid valve is provided on the bypass branch.

12. A heat pump system, comprising:

a compressor having an inlet and an outlet;

an indoor heat exchanger;

an outdoor heat exchanger configured as an interlaced heat exchanger having at least two refrigerant flow paths;

a plurality of throttling elements respectively arranged between any two of the indoor heat exchanger and the at least two refrigerant flow paths of the outdoor heat exchanger; and a first type four-way valve and a second type four-way valve, with at least one port of the first type four-way valve and at least one port of the second type four-way valve are each respectively connected to the inlet and the outlet of the compressor, the indoor heat exchanger, and one of the at least two refrigerant flow paths of the outdoor heat exchanger;

wherein, in a local defrosting mode, two paths of refrigerant from the outlet of the compressor flow respectively through the indoor heat exchanger and at least one of the at least two refrigerant flow paths of the outdoor heat exchanger, and then sequentially through the throttling elements, at least the other of the at least two refrigerant flow paths of the outdoor heat exchanger, and the inlet of the compressor;

wherein, the outdoor heat exchanger is configured such that the at least two refrigerant flow paths are at least three refrigerant flow paths and a plurality of the first type four-way valves and/or the second type four-way valves are provided, wherein, each of the first type four-way valves and/or each of the second type four-way valves connect to a refrigerant flow path of the at least three refrigerant flow paths respectively;

wherein, in a local defrosting mode, refrigerant from the outlet of the compressor flows sequentially through a plurality of the at least three refrigerant flow paths connected to the first type four-way valve, the throttling elements, a plurality of the at least three refrigerant flow paths connected to the second type four-way valve, and the inlet of the compressor; or refrigerant from the outlet of the compressor flows sequentially through a plurality of the at least three refrigerant flow paths connected to the second type four-way valve, the throttling elements, a plurality of the at least three refrigerant flow paths connected to the first type four-way valve, and the inlet of the compressor.

* * * * *